US006955067B2

(12) United States Patent
Davenet et al.

(10) Patent No.: US 6,955,067 B2
(45) Date of Patent: Oct. 18, 2005

(54) SMART DOSING DEVICE

(75) Inventors: Dorothee Hélène Davenet, Geneva (CH); Jean-Luc Azzani, Rome (IT); Bradford Scott Barron, Wemmel (BE); Todd Mitchell Day, Bethel, OH (US); Luca Diamanti, Rome (IT); Christopher Lawrence Smith, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 90 days.

(21) Appl. No.: 10/108,740

(22) Filed: Mar. 28, 2002

(65) Prior Publication Data

US 2003/0182732 A1 Oct. 2, 2003

(51) Int. Cl.[7] ..... D06F 39/02

(52) U.S. Cl. ..... 68/17 R; 68/207; 68/213; 68/235 R; 222/52

(58) Field of Search ..... 68/235 R, 17 R, 68/207, 213; 222/52, 638

(56) References Cited

U.S. PATENT DOCUMENTS

| | | | | | |
|---|---|---|---|---|---|
| 2,289,508 | A | * | 7/1942 | Lawler | 206/5 |
| 2,698,022 | A | * | 12/1954 | Fanhoe | |
| 2,956,709 | A | * | 10/1960 | Nison et al. | |
| 3,095,722 | A | * | 7/1963 | Fox | |
| 3,180,538 | A | | 4/1965 | Brown et al. | |
| 3,399,806 | A | * | 9/1968 | Lucas | |
| 3,490,647 | A | * | 1/1970 | Portyrata | 222/1 |
| 3,888,391 | A | * | 6/1975 | Merz | |
| 4,014,105 | A | * | 3/1977 | Furgal et al. | |
| 4,379,515 | A | * | 4/1983 | Towsend | |
| 4,539,717 | A | * | 9/1985 | Fattori | 4/227.3 |
| 4,703,872 | A | | 11/1987 | Cornette et al. | |
| 5,046,336 | A | * | 9/1991 | Ferguson et al. | 68/17 R |
| 5,538,163 | A | * | 7/1996 | Dassi | 222/146.5 |
| 5,697,230 | A | | 12/1997 | Ender et al. | |
| 5,768,918 | A | * | 6/1998 | McKibben | |
| 5,950,458 | A | * | 9/1999 | Meyer et al. | |
| 5,971,645 | A | * | 10/1999 | Fukushima et al. | 401/183 |

FOREIGN PATENT DOCUMENTS

| | | | |
|---|---|---|---|
| EP | 0 236 136 A2 | | 9/1987 |
| EP | 0 432 319 A1 | | 6/1991 |
| GB | 2157717 | * | 10/1985 |
| JP | 63-222797 | * | 9/1988 |
| WO | WO 97/09480 A1 | | 3/1997 |
| WO | WO 01/25527 A1 | | 4/2001 |

OTHER PUBLICATIONS

European Patent Office 288,347 Oct. 1988.*
Translation of WIPO Internation Publication WO–97/09480 (Schuhwerk) Mar. 13, 1997.*

* cited by examiner

*Primary Examiner*—Frankie L. Stinson
(74) *Attorney, Agent, or Firm*—Brent M. Peebles; Jeffrey V. Bamber; Kim William Zerby

(57) ABSTRACT

A portable, self-contained, device for dosing and/or dispensing at least one product into an appliance for treating laundry or dishes is disclosed. The device includes a housing with at least one compartment for containing at least one product. The compartment(s) can be closed by at least one corresponding cover. The device further includes at least one means for storing and releasing energy, so that the product to be dispensed may be released at one or more predetermined point(s) in time during a wash cycle. In one embodiment, the means may be a battery, such as a rechargeable battery. The device may also include at least one sensor and/or at least one actuator for detecting when the wash conditions are optimal and open at least one of the compartments for releasing a product.

2 Claims, 5 Drawing Sheets

6.A.

6.B.

6.C.

6.D.

SMART DOSING DEVICE

This application claims the benefit of the filing date of international patent application number PCT/US00/27016 filed Sep. 29, 2000, which claims the benefit of European patent application EP 99870204.7 filed Oct. 1, 1999.

FIELD OF THE INVENTION

The present invention relates to devices for dosing treatment compositions to be released into a medium, in particular those required for use in fabric and home care.

BACKGROUND OF THE INVENTION

Dosing devices for dosing treatment compositions in a dish or laundry washing machine are representative of the various dosing devices to which the present invention can apply. Typically, such dosing devices comprise at least one compartment which is filled with product by the consumer, and at least one opening which is such that said product is mixed with wash water during a wash cycle. Such dosing devices are interesting because the compartment is usually designed such that it contains substantially the amount of product necessary for one wash cycle. So the dosing device allows for dosing and direct release of the product onto the items to be treated. Such dosing devices are usually re-usable.

A lot of improvements have been brought to dosing devices through the years, all directed to a better dosing and/or release the product during the wash. Especially, it was seen as an important feature that the release of the product may be delayed, for example till the last phase of the wash cycle.

Some dosing devices comprise more than one compartment. Typically this type of devices are used for products that are incompatible, but which must be added in the same wash water, for example in EP.0.236136 A1 to Unilever.

Some other devices comprise a means for releasing their contents progressively during the wash cycle, or even at some point in time during the wash, for example at the spin drying phase or during the last rinse. In case the release needs to be progressive, the device comprises for example vents shaped as restricted openings, for example in U.S. Pat. No. 4,703,872 to Procter and Gamble. In case the release needs to be delayed in the wash cycle, the device comprises mechanical means, for example it uses temperature of the wash water, and the difference of retraction properties of its constitutive materials: for example U.S. Pat. No. 5,768,918 discloses a device comprising a main compartment and a cover to releasably close said compartment, both made out of two different materials. Before the wash, the user fills the device and closes the compartment with the cover. During the wash, at the time the temperature of the wash water changes, typically during the last rinse, the retraction of the cover is more important than the retraction of the compartment's material, such that said cover slides open from said compartment, thereby releasing the contents. Another means used for release product at one point in time during the wash is the use of the centrifugal force at the time of the spin drying. Devices using a compartment releasably closed with a cover that is closed by the user before the wash and then opened by the centrifugal force is for example disclosed in U.S. Pat. No. 3,888,391 to Procter and Gamble.

Other embodiments were found to improve the release of the product at one point in time during the wash, for example the use of porous membranes, for example as disclosed in EP.0.236136 A1.

The dosing devices which can be found in the art solve some issues. However, it appears that in some cases, the conditions in the wash water change from one wash cycle to another, when using the same washing machine. Such conditions depend on the amount of items to be washed, the nature and amount of product that is used, the water hardness, and other parameters. So one main disadvantage is that the opening of the dosing device and release of the product cannot be pre-determined, but depends only on wash water characteristics, which are likely to vary from one wash cycle to another.

It is therefore one main object of the present invention to provide the user with a dosing device which is portable and self contained, so that it can be used for in-house applications, which comprises a means to release the device's contents at a predetermined moment of the wash cycle. In addition, it is an object of the present invention to provide a device that allows to release products that could not be released by a washing machine.

SUMMARY OF THE INVENTION

The present invention is directed to a portable, self-contained, device for dosing and/or dispensing at least one product into an appliance for treating laundry or dishes, said device comprising a housing with at least one compartment for containing said at least one product, said at least one compartment being closed by at least one corresponding cover, wherein said device comprises at least one means for storing energy and releasing it, such that said product is released at one or more predetermined point(s) in time during the wash cycle.

Preferably, said means is a battery, more preferably a rechargeable battery. Also preferably, said device comprises at least one sensor and/or at least one actuator for detecting when the wash conditions are optimal and open at least one of said at least one compartment for releasing a product.

BRIEF DESCRIPTION OF THE DRAWINGS

The invention will now be explained in detail with reference to the accompanying drawings, in which.

DETAILED DESCRIPTION OF THE INVENTION

Figure 1:
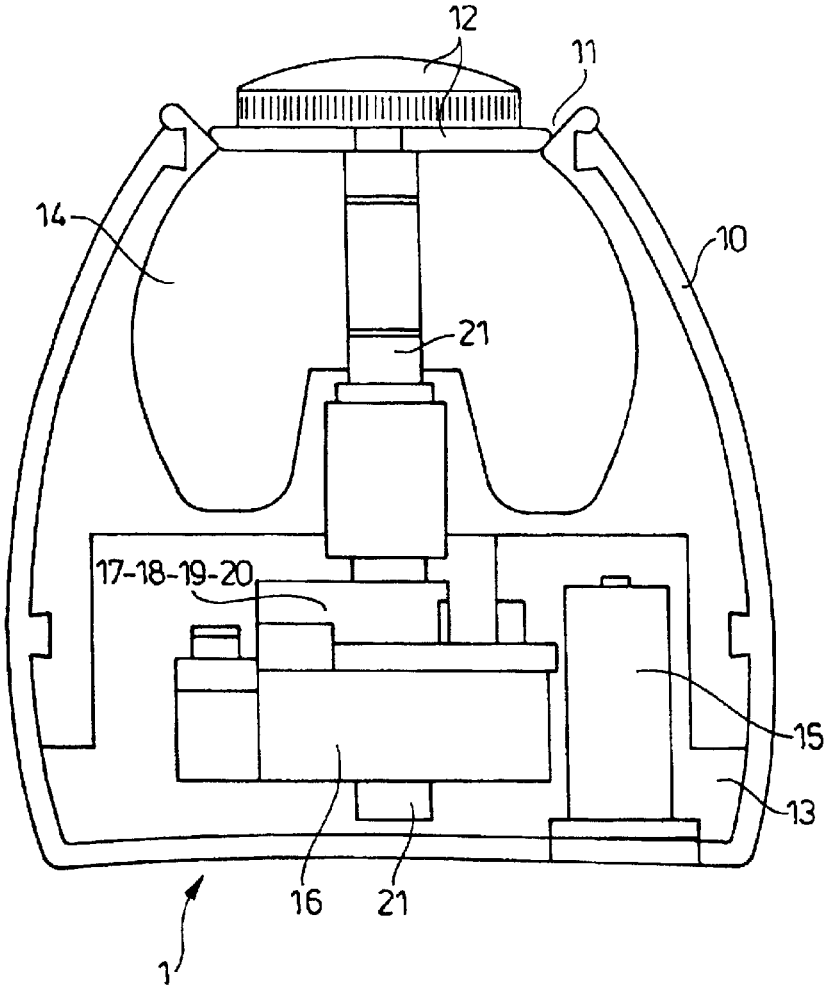
FIG. 1 is a profile cut view of a dosing device according to the present invention, in the closed position, with cover positioned for opening towards the outside of the device.
Figure 2:
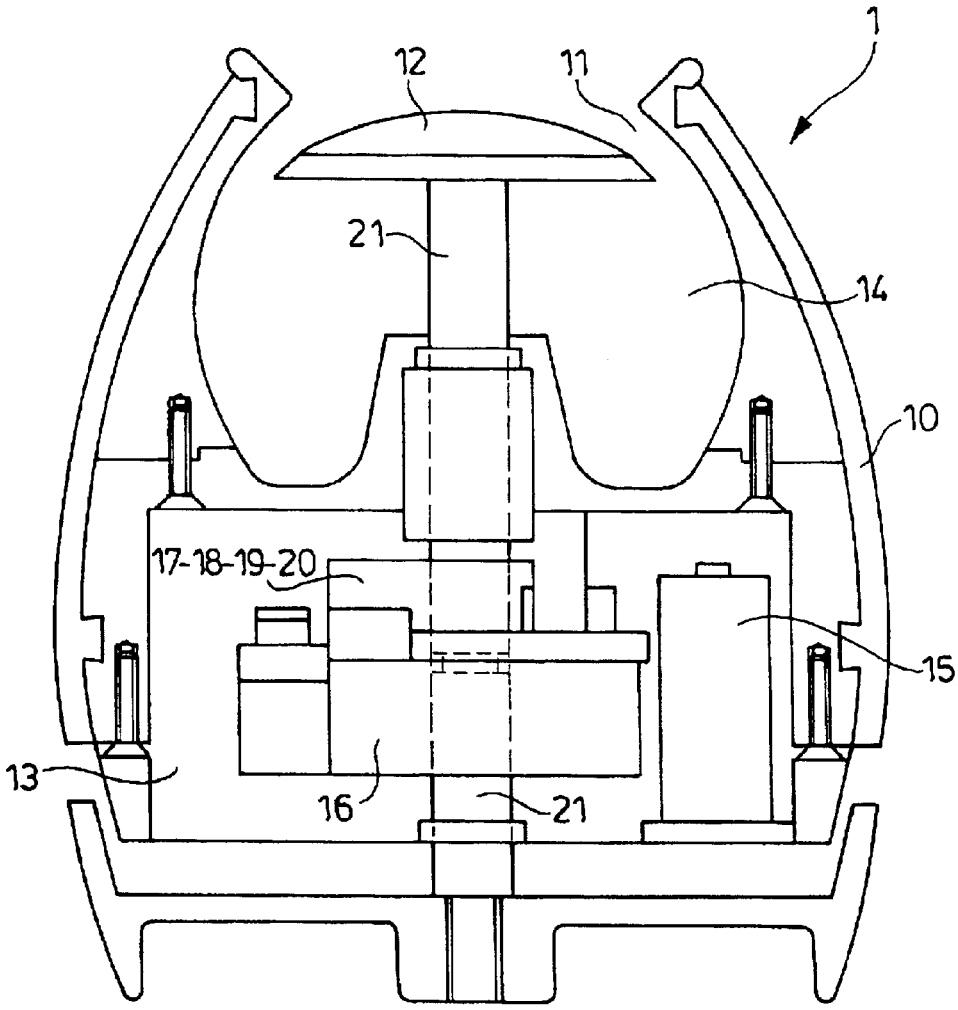
FIG. 2 is a profile cut view of a dosing device according to the present invention in the open position, with cover positioned for opening towards the inside of the device.
Figure 3:
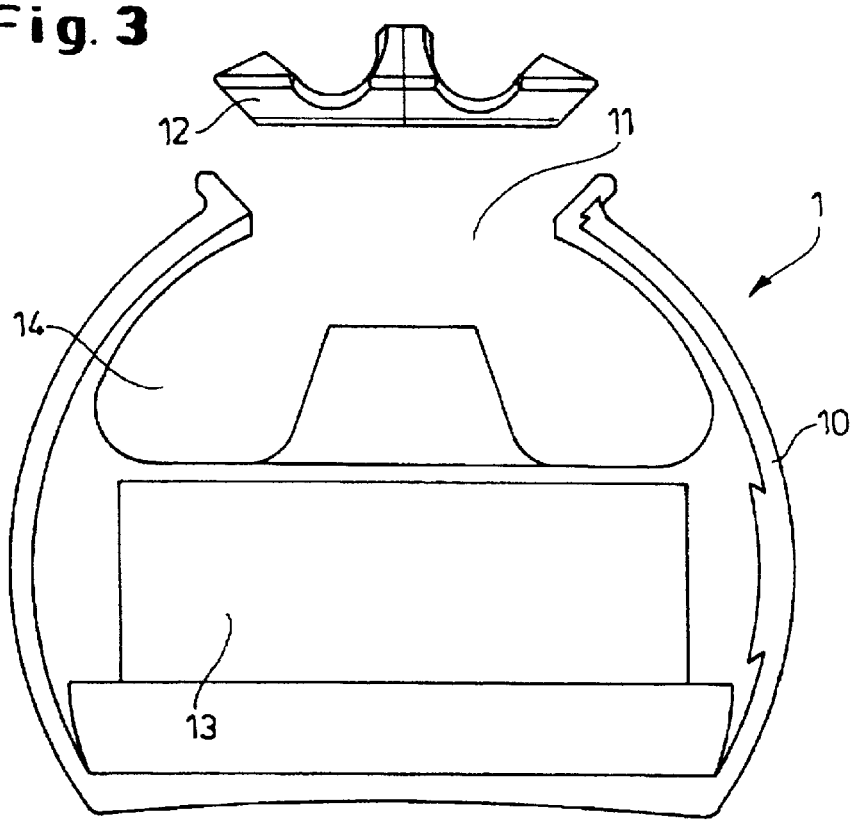
FIG. 3 is a profile cut view with the housing, cover and plunger rod of a dosing device according to the present invention.
Figure 3:
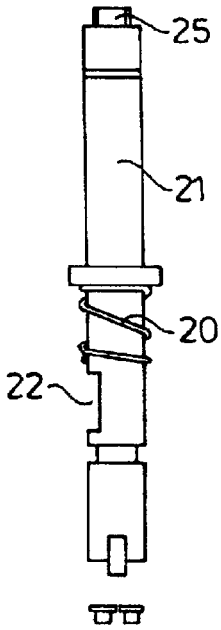

As per FIGS. 1, 2 and 3, the dosing device (1) of the present invention comprises a housing (10) with at least one opening (11). Said opening (11) is removably closed by a cover (12). Inside the housing (10), the dosing device (1) comprises at least one compartment for the electromechanical components, and at least one other product compartment (14) for filling with the product to dose and dispense. Said at least one product compartment (14) can have any suitable shape, such that once the dosing device (1) is opened, the release of its contents is easy and complete (even if progressive). While the dosing device (1) can have any suitable shape, in one embodiment it is made out of two hemispheres, one comprising at least one product compartment (14) for containing at least one product to be released, and the other hemisphere comprising an electromechanical compartment (13) containing the power supply, at least one sensor (16), actuator systems (17), and a microchip (18) for driving a logic control program.

The dosing device (1) according to the present invention is primarily suitable for dosing any type of product that is used for treatment of items. Preferably it is for dosing products for use in fabric and dish care, more preferably detergent compositions. Products suitable for use with the dosing device (1) of the present inventions include but are not limited to: laundry detergents and additives, bleach-based products, hypochlorite-based products, dishwashing compositions, perfumes, malodor removal compositions, fabric softeners, disinfectant, easy ironing, detergent boosters (enzymes) . . . The dosing device (1) of the present invention can have various uses that require release of treatment product into a medium, at one time or sequentially. Such uses include but are not limited to: dish-washing, hot air drying of fabrics or the like, release of body care products in a bathtub, release of shower gel or shampoo, release of light duty liquids in the sink for assisting hand dish washing, release of cleaning or perfuming products in the tank of toilets, etc . . . In the following description, and for the sake of clarity, the example will be given of application of the dosing device (1) for treatment of fabrics in a laundry washing machine.

By dosing device (1), it is meant a device with which it is possible to measure the right amount of product to be released during a wash cycle, depending on the wash conditions, including but not limited to the amount of items to be washed, the composition of the washing environment (for instance the wash water), the nature of the product which is used for the wash . . .

In one preferred embodiment, the dosing is made by the user her/himself. For example, this can be done by using the size of the device's compartment to measure the right amount of product to be released in the wash. In this case, the device comprises a means, for example dosing line-up marks, that will help the user chose the right amount of product to fill in. Alternatively, the user can introduce a cartridge of product into the dosing device (1), said cartridge containing a predetermined amount of product, e.g. for one or several wash(es).

In another embodiment, the dosing is done by the device itself, which is constructed so that its at least one compartment can be opened and closed again during the wash. In this case, the compartment does not comprise line-up marks, the user fills it completely before the wash. During the wash, the dosing device (1) first opens to release product, then senses when the concentration of product is sufficient and finally closes to prevent over-dosing of the product. In this case, the concentration sensing is done by a checking one component which is a characteristic of the product to be released, for example, the level of chlorine can be sensed, in case the product to be released is bleach. The skilled person will be able to determine which compound must be sensed, depending on which product is released. Of course, a corresponding and suitable sensor (16) must be integrated to the dosing device (1) in this case, and the control logic program must be adapted accordingly.

When closed, the dosing device (1) can be of any suitable shape, for example cubic, but it is preferably substantially spherical, and more preferably, it is designed such that once closed and ready to be placed in a washing machine, its overall surface is as smooth as possible, so that no sharp protrusion can damage the items which are being treated. Indeed, one possible use of the dosing device (1) of the present invention is the use for releasing fabric care products in a laundry washing machine, thus it is necessary that the device's surface be as smooth as possible so as not to tear the fabric during the wash, even when the device is open. In a preferred embodiment, the dosing device (1) comprises a means for making it stand on a flat surface, for example on a table. This means can be for example a flat portion of the housing (10)'s outside surface, or a stand. Alternatively, the electronic components of the dosing device (1), which are the heaviest part of said device are located in the bottom portion of said device, so that when the device is put on a flat surface, it always stays in the upright position.

Once open, the dosing device (1) most preferably stays into one whole part, so that the user does not have to remove more than one portion of the device from the washing machine's drum after the wash.

The materials used for the housing (10) and the cover (12) might be of any type, and they may be made out of one single or several materials. Preferred materials for the housing (10) and the cover (12) are synthetic materials, for example plastic or rubber, so as to resist to liquids and or temperature variations. It is highly preferred that once closed, the dosing device be liquid-tight. Of course, all materials constitutive of the dosing device (1) will be chosen such that they resist to the conditions of use. Preferably, they are heat resistant so as to be used in the tumble of a clothes hot air dryer without damage, or into a dishwashing machine. Example of hard materials include but are not limited to polypropylene (PP), polycarbonate (PC), copolymers of butadiene and styrene, and the like.

The housing (10) and the cover (12) are preferably made by injection molding. In case they are made out of more than one material, co-injection molding process will be preferred, where applicable, since it is less expensive than molding several insert portions separately and then assemble them. For instance, co-injection molding can be used for the housing (10), to make it out of hard plastic, with some portions out of a non-slipping rubber material. It is preferred that at least some portions of the dosing device's outer surface (including housing (10) and cover (12)) are made out of a rubber like material, which will help to prevent noise from tumbling in the machine. Alternatively, in one embodiment of this invention, the dosing device (1) can be secured to the walls of the washing machine's drum, for example by means of a magnet. In this way, the noise due to the tumbling of said dosing device (1) inside the drum during the wash is canceled, or at least substantially reduced.

Alternatively, a rubber sleeve is fitted around the device's main body and cover (12).

It is an essential feature of the dosing device (1) of the present invention that it comprises at least one means for storing energy (15) and releasing it, such that the contents of said dosing device (1) is released at a given predetermined time during a wash cycle. It is highly preferred that the dosing device (1) also comprises at least one sensor (16) which is linked to the means, to determine when the environment, for example the wash water, requires that the dosing device (1) be opened and the product released. Also preferably, the dosing device (1) comprises an actuator (17) which is linked to the cover (12), so as to activate the opening (11) of said cover (12) during the wash. Finally, the dosing device (1) further comprises a microchip (18) that monitors the data received from the sensors (16), and gives a signal to the actuator (17) to open said dosing device (1) at the right time during the wash cycle.

It is also an essential feature of the dosing device (1) of the present invention that it be portable, that is to say that it is not too bulky and heavy and can easily be handheld and manipulated by a user for in-house usage. Its dimensions must be such that it can be put into the drum of an automatic washing machine, or clothes hot air dryer, or into a dish washer. Preferably, its greatest outer dimension does not exceed 20 cm. Also preferably, its overall weight does not exceed 5 kg when empty, more preferably, it does not exceed 2.5 kg when empty, even more preferably its weight is not more than 1 kg when empty. At the same time, the size and/or shape of the dosing ball must be such that it cannot be entrapped between two parts of the washing machine, for example between the drum and the outer casing of a washing machine or dryer, especially in the American types of machines.

Finally, it is an essential feature of the dosing device (1) of the present invention that it be self contained. By self contained, it is meant that the dosing device (1), once filled with product and closed, can work independently from any other device. Particularly, it comprises its own power source, and all means necessary for it to determine properly the right time its contents needs to be released, only by sensing its external environment. In one alternative, the power is transmitted via a coil transmitter, which receives electricity via a remote generator.

Means for Storing Energy

It is an essential feature of the dosing device (1) of the present invention that it comprises at least one means for storing energy (15) and releasing it, such that the contents of said dosing device (1) is released at a predetermined point in time during the wash. Preferably, said means is stored in the electromechanical compartment (13) of the dosing device (1).

In a preferred embodiment, said means is a throw-away battery, or rechargeable battery. More preferably, the battery is not rechargeable, but contains sufficient energy for lasting at least one year in normal conditions of use. By normal conditions of use, it is meant an average of 1 to 2 uses per week. For example, one or more AA rechargeable or disposable batteries can be used, the batteries being housed in the device. The voltage output of the battery is typically between 1.5 and 12 Volts, with a preferred output between 3 and 6V, for example one DL223A 6 volt battery. A good alternative is lithium batteries which are smaller and last longer.

In the case the device comprises rechargeable batteries, the housing (10) preferably comprises a plug recess, in order for the user to plug the dosing device (1) on the main electricity to recharge it, or via a wireless connection.

In an alternative embodiment of this invention, the means for storing energy (15) is a kinetic battery. The kinetic battery comprises a rechargeable battery coupled to a mechanical movement which transforms any movement of said battery into electricity that can be stored. Such kinetic batteries are known, for example in the watch industry, and the type of kinetic battery suitable for use with the dosing device (1) according to the present invention will be appropriately chosen by the person skilled in the art.

Sensor Technology

It is an essential feature of the dosing device (1) of the present invention, that it comprises at least one sensor (16), as shown in FIGS. 1 and 2. By sensor it is meant a chip or similar electronic device which detects a stimulus in the dosing device's environment, for example in the wash water. Preferably, the sensor (16) is directly coupled to a microchip (18) which transforms the stimulus into an electric impulsion which is sent to the means and then, the actuator (17). The sensor (16) is housed in the electromechanical compartment (13) of the device and secured for example with brackets and screws. The microchip (18) which is preferably integrated to the sensor (16) itself is an electronic circuit which runs a basic program, so called logic control program. The logic control program integrates different parameters of the wash which are sensed in the medium (e.g. the wash water), and also integrates the type of product that needs to be released, in order to calculate at what time(s) during the wash, said products must be released. The specific construction of the electronic circuit of the microchip (18) will be appropriately chosen by a person skilled in the art.

The sensor (16) structure and construction shall be adapted to the stimulus to be detected, and the choice of the appropriate sensor (16) construction will be easily determined by a person skilled in the art. The dosing device (1) of the present invention comprises at least one sensor (16), such that it can react to at least one stimulus present in its environment. It will be appreciated that the more stimuli said device detects, the more accurate the product dosing and/or release will be. In the following embodiments of the present invention, wash water in the drum of a laundry washing machine is taken as one example of the dosing device (1) environment, but this example shall not be meant to restrict the scope of applications of the dosing device (1).

In a first embodiment of the present invention, the sensor (16) reacts to pH level into the wash water. In this case, a preferred sensor (16) is a pH sensitive electrode for delicate measurement in the drum of the washing machine. The pH of the wash water essentially depends on the amount and composition of the detergent. During a wash cycle, the pH varies between the main wash and the last rinse, typically between 8.2 and 7.2 for a liquid detergent, and between 10.5 and 7.2 for a powder detergent, of course, these figures depend on the water hardness.

In a second embodiment, the sensor (16) reacts to the drum rotation speed. In this case, the sensor (16) is preferably an accelerometer combined with a chip which sends an electric signal to the actuator (17) whenever a certain acceleration or deceleration is obtained. Typically, drum rotations vary from 30 to 60 drum RPM during the wash, and from 100 to 1400 RPM during the spin cycle. Some washing machines also have a quick spinning during the main wash. Generally, a spin cycle is observed at the end of each rinse, except for delicate fabric programs.

In a third embodiment, the sensor (16) reacts to the variation of temperature in the wash water. Typically, the wash water temperature varies from 12° C. up to 95° C., depending on the type of wash program which is selected. The temperature also varies during a same wash cycle. For example, some temperature profiles show a constant temperature for a while in the main wash, whereas with some other washing machines, the temperature increases, shows a peak and then decreases during the main wash. A common denominator is the decrease of temperature at the end of the main wash. This drop of temperature at the end of the main wash is a common feature of all brands, types, and programs of washing machines. This drop is due to the dilution by adding cold water and/or the purge of the main wash water (except for cold wash programs), followed by an addition of cold water for the first rinse. This drop can be easily identified by using a sensor (16) that detects a variation of temperature, or the speed of variation of temperature over a period of time. This drop of temperature at the end of the main wash can be used for releasing for example a bleach, in the first rinse.

In a fourth embodiment, the sensor (16) reacts to the wash load. The wash load typically varies during a same wash cycle, depending on the water entering or exiting the drum. Typically, once the drum has been loaded and is closed, there is a first increase due to the water coming in for the first wash, then a plateau during the main wash, then an exponential increase due to addition of water, then a drop due to purge, which means the end of the main wash, then a new increase due to rinse. The variation of wash load will allow the device to determine what step of the wash is being performed, and thus, release its contents at the right time.

In a fifth and preferred embodiment of the dosing device (1) according to the present invention, the sensor (16) is a conductivity analyzer. Such a sensor analyses the concentration of laundry detergent or another ionic liquid solution. Such a sensor can be achieved for example by a four contact capacitive measurement device. This enables to coat the contacts themselves with a thin layer of non-conductive protective material thereby removing the risk of contact degradation through electrochemical action. It should be noted that any measurement of ionic conductivity, such as this, should be preferably performed using alternating signals (ac) to prevent ion migration opposing an applied dc field. The measurement with such a four contact sensor is done by passing an ac current, which is measured (A), through the liquid via the two outer contacts, and measuring the voltage (V) developed across the two inner contacts. The conductivity of the liquid is proportional to A/V, irrespective of the contamination between the contacts and the liquid (such a contamination is usually due to accumulation of compounds on the surface of the electrodes).

In another embodiment of this invention, the dosing device (1) is coupled to a sensor (16) which is secured into the washing machine, for example into the powder or additive drawer of the machine, or alternatively into the pipes of the washing machine. Said sensor (16) is a conductivity analyzer which determines when there is addition of water. Said conductivity sensor (16) is coupled to the dosing device (1) by radio-frequency link. This allows to determine addition of water to the wash, even when there is already water inside the drum, and thus, it allows the dosing device (1) to detect a new addition of water while it is already immersed during a wash cycle. This improves the accuracy of the dosing device (1) in determining the different steps of a wash cycle, and thus improve the determination of the right time to release its contents.

All the above parameters can be detected one by one, but the device preferably combines at least two, more preferably at least three different sensors (16), so that it can better determine the right time for releasing its contents. Indeed, one parameter, for example temperature may vary from a washing machine to another, and from one program to another. It has been found that, by combining several parameters to be detected, the determination of the steps of a wash cycle is more accurate. It has been found that surprisingly, combination of detection of conductivity and acceleration leads to a very good determination of when the product should be released during the wash cycle. This is even improved when combining conductivity and acceleration of the drum with the temperature of the wash water.

The sensors (16) as described above are used for determining the wash conditions, and more particularly in two distinct situations: (a) learning what are the main steps of a wash cycle, in case the dosing device comprises a learning memory, and/or (b) determining the wash conditions, once the dosing device knows what are the characteristics of the wash cycles that can be selected, so that by sensing, said dosing device detects what phase of the wash cycle is running.

Actuation

The release of the contained product during a wash cycle relies onto the actuation of a means to open the cover (12). In a first embodiment of the present invention, the opening (11) of the cover (12) and release the dosing device's contents is only powered by the means for storing energy (15), for example a battery, via an electromechanical actuator (19), for example an electrical motor, a solenoid, or a nitinol wire.

In a second and preferred embodiment of the invention, the energy used for moving the cover (12) in open position is mechanical energy which was furnished by the user himself before the wash. Said mechanical energy is contained in a mechanical actuator (20). At the time the device detects that the product needs to be released, an electromechanical actuator (19) (powered by the means for storing energy (15)) will release the mechanical energy stored into the mechanical actuator (20), thus acting as a transition actuator. The main reason for such a transition actuator is the following: the dosing device (1) must be easy and convenient to use, and thus it must be as light and small as possible. A good way to make it light and small is to reduce the size of its components, and especially the size of the means for storing energy (15). The amount of energy to open the cover (12) is quite large, and if it would be furnished only by a battery for example, the size of this battery would be so large that it would not meet the above cited requirements in terms of weight and size of the dosing device (1). Thus, it has been found that the energy directly used to open the cover (12) can be purely mechanical and given by the consumer himself. The means for storing energy (15), for example the battery is only used to release said mechanical energy.

The mechanical energy to move the cover (12) in open position can be achieved by any suitable means, but in a preferred embodiment of this invention, said mechanical energy is achieved by a coiled spring (20), more preferably a metallic coiled spring (20), as shown in FIGS. 1 to 3. At the time the user presses on the cover (12) to close the dosing device (1), the coiled spring (20) is compressed and loaded with mechanical energy. The coiled spring (20) stores spring energy into the device to reduce the amount of energy to be used from the battery to activate the opening (11) of said device.

The device comprises a locking means (22) to releasably lock the coiled spring (20) in its compressed position (thus charged with spring compression energy), said locking means (22) being unlocked by the electromechanical actuator (19) which is powered by the battery. The locking means (22) is preferably achieved by a locking tooth (23) located on the plunger rod (21). The plunger rod (21) is linked to the cover (12). To this locking tooth (23) corresponds a retractable shaft (24) which is linked to the electromechanical actuator (19), as shown in FIGS. 4, 5, 6A to D. When the user closes the device, the shaft of the electromechanical actuator (19) engages with the locking tooth (23) of the plunger rod (21), so as to lock the spring in its compressed stage.

If the dosing device (1) comprises more than one compartment, each compartment is closed by a cover (12)

which is linked to a separate plunger rod (21), each of which is locked/unlocked by the shaft of a corresponding electromechanical actuator (19). Optionally, in case the dosing device (1) is to be used by the user to measure the right amount of product to dose before the wash, the plunger rod (21) comprises fill dosing marks for different size doses. In one embodiment of the invention, the cover (12) of the dosing device (1) is removable. For example it can be unscrewed from the plunger rod (21). Thus, the top extremity of the plunger rod (21) comprises threads (25) to fit in corresponding threads of the cover (12). Alternatively, the threads can be replaced by bayonet means. Preferably, both cover (12) and plunger rod (21) comprise matching double lead threads for quicker engagement.

Once the dosing device (1) has been filled, and prior to place into the washing machine, the user must switch it on by using an on/off mechanism In a first embodiment of the present invention, the on/off mechanism is integrated into the bottom of the plunger rod (21), that activates the device when the user closes said device, and deactivates at the time the device opens during the wash and releases the product contained therein.

In a second embodiment, the on/off mechanism is also dependent from the plunger rod (21) and cover (12), but is independent from the closing of the dosing device (1): the switch is a "turn to activate" switch. To switch the device on, the user has to use the cover (12) and twist it.

In a third embodiment, the switch is independent from the plunger rod (21) and cover (12), and is preferably located at the surface of the device's housing (10). It is used independently from any other operation, just as any normal switch.

The first embodiment is preferred in case the dosing device (1) releases its contents in one go during the wash. In this case, the device automatically switches off after opening (11) of the cover (12). One advantage is that the battery lasts longer because its not used during the rest of the wash cycle. In the second and third embodiments, the device does not switch off after a first release, so these constructions are preferred in case the device is means to release its contents at more than one point in time during a wash cycle.

Preferably, the plunger rod (21) is designed with a flat anti-spin geometry at one side, to prevent turning during the wash. Also this prevents turning of the rod in the case the dosing device (1) is on/off activated by twisting the cover (12).

The electromechanical actuator (19) can be achieved through any suitable means such as linear or rotary actuators, for example servos, solenoids, stepper motors, pancake motors or custom manufactured linear and rotary actuators, permanent or electronic magnets. If the dosing device (1) comprises more than one compartment and said compartments are meant to be opened at different times during the wash cycle, the dosing device (1) preferably comprises independent electromechanical actuators to actuate the opening (11) of the compartments separately.

Figure 4:
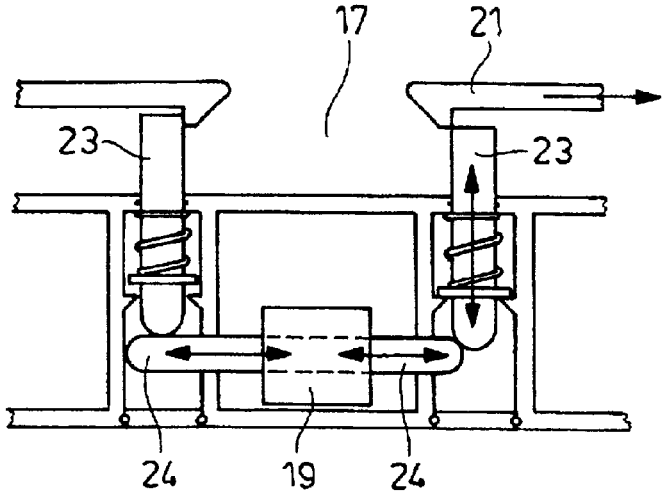
FIGS. 4 and 5 are profile views showing various embodiments of the actuator.
Figure 5:
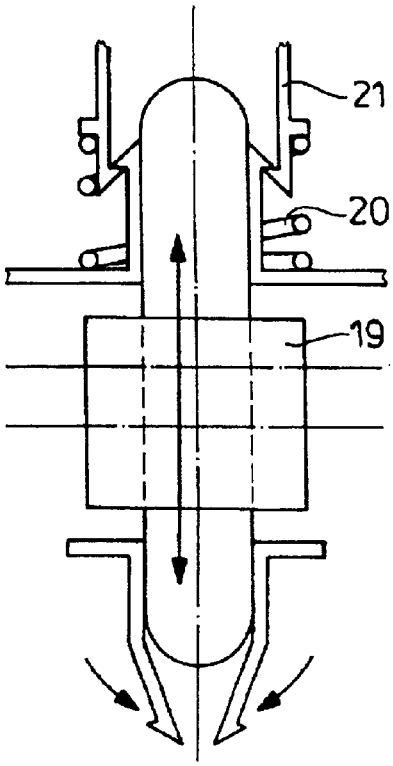

In one embodiment of the device according to the present invention, the electromechanical actuator (19) is achieved by a solenoid (19) as shown in FIGS. 4 and 5. The solenoid (19) comprises a retractable shaft (24) which moves in/out of the plunger pin's locking tooth (23). When the solenoid (19) is activated by the battery, its shaft retracts into the solenoid (19) coil, out of the locking tooth (23) of the plunger rod (21), and thus, releases the mechanical energy contained into the compressed coiled spring (20), thus moving the cover (12) into its open position, and allowing release of product from the dosing device (1).

Figure 6:
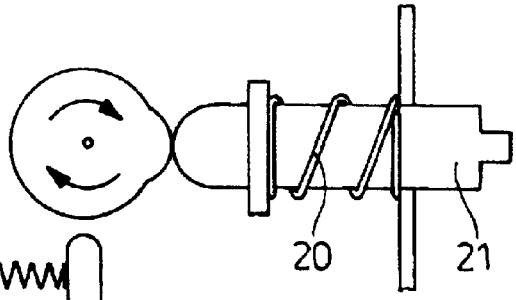
FIGS. 6A, B, C and D are schematic views showing various embodiments of the locking mechanism for securing the dosing device in closed position.
Figure 6:
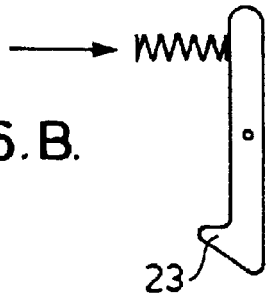
Figure 6:
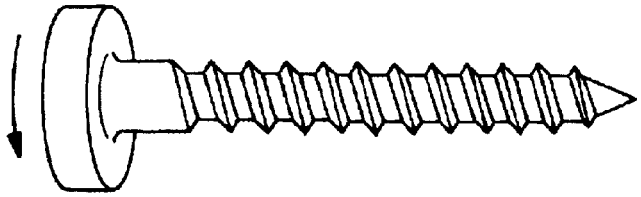
Figure 6:
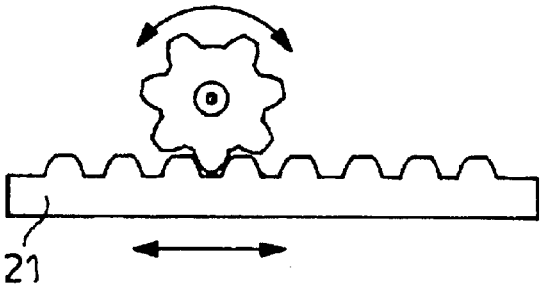

As shown in FIGS. 6 A, B, C and D, other alternatives exist for the electromechanical actuation. For example it can be a cam style reciprocating motion (A), or a cam style with lever arm pivot (B), or a rotary threaded multi lead (C), or a rack and pinion (D), or a crank shaft style reciprocating motion (not shown).

Compartment(s)/Valve(s)

The main housing (10) comprises at least one product compartment (14) for storing at least one product. Preferably, the global containment volume is 100 ml, with a 20% overfill capacity, more preferably 150 ml with a 20% overfill capacity. Also preferably, and as shown in FIGS. 1, 2 and 3, the compartment is bored out on the bottom to allow the plunger rod (21) to slide and open/close the cover (12). More preferably, said bore is covered with a chemical resistant plunger rod (21) seal with a canted coil spring that adjusts the wear on the rod. For example, the chemical resistant plunger rod (21) seal is made out of Teflon™.

Once in the closed position, a thermoplastic elastomer gasket preferably seals the interface between the cover (12) and the housing (10) of the dosing device (1). More preferably, said gasket is made out of a soft urethane elastomer.

In addition, the housing (10) preferably also comprises a battery door which is located at the bottom of the dosing device (1). This provides an access for the user to replace the batteries in case those are not rechargeable. Said battery door is sealed by a thermoplastic elastomer gasket, preferably a soft SANTOPRENE™ elastomer gasket, similarly to a product compartment (14). Most preferably, there is no door and the battery is sealed inside the device. While this prevents changing the battery it gives an added level of security against leaks.

In case the dosing device (1) comprises several compartments, these compartments can be closed by the same cover (12), or they can be closed separately. In a first embodiment of the present invention, the compartments are closed by a diaphragm, which is similar to diaphragms used in the camera industry, i.e. diaphragms which comprise several panels sliding one onto the other. In another embodiment, the compartments are closed by telescopingly attached plates which are movable one from the other, and which retract progressively: the first plate moves to open the first compartment, and then moves and pushes the second plate, to open the second compartment, etc . . . Such opening/closing systems allow to efficiently monitor the opening/closing of the compartments, while using a system which is reduced in size and uses very little energy.

Additional Features

In one embodiment of this invention, the dosing device (1) is equipped with a scanner which can read a bar-code onto the label of a bottle. This allows the user to use the same dosing device (1) to dose and dispense different types of products, which should be released at different times during a wash cycle. In this embodiment, the at least one sensor (16) of the dosing device (1) contains several programs, each of which is linked to one type of product, for instance, one program for bleach, another one for softeners. Before the wash, the user scans the bottle, so that the dosing device's sensor (16) recognizes the type of products and switches to the right program of detection. Several types of scanners can be used, for example a barcode scanner or a RFID scanner (radiofrequency identification scanner).

In another embodiment, the dosing device (1) comprises at least one LED which works as an electronic guardian battery load monitor. For example, the LED blinks when the system has proper voltage, and it is steady when the voltage is low. The LED is mounted in the electromechanical compartment (13), and yet, is visible on the outside of the device through a plastic light pipe. In one embodiment, the LED gives a signal, for example by blinking, at the end of the wash to warn the consumer that the release of product worked well. Alternatively, the signal can be given by a sound.

Contents

The dosing device (1) according to the present invention is primarily suitable for dosing any type of product, preferably it is for dosing products for use in fabric and dish care, more preferably detergent compositions. Products suitable for use with the dosing device (1) of the present inventions include but are not limited to: laundry detergents and additives, bleach-based products, hypochlorite-based products, dishwashing compositions, perfumes, malodor removal compositions, fabric softeners . . .

They can be used under any suitable form, including but not limited to: nano-components in a liquid or gel medium, granules, liquids, solid blocks to be grated, foams, gases, aerosols, salami to be dosed in slices, mega-pearls, etc . . .

Control Logic

Once the dosing device (1) is constructed and ready to work, it still needs to integrate two parameters: the type of product that will be used, and the type of wash cycle. The type of product will determine at which phase of the wash cycle, said product will be released. It is not a subject of the present invention to give an exhaustive list of products that can be released by using the dosing device (1), nor to explain at what time during a wash they must be released. This is within the normal knowledge of a skilled person. The determination and memorization of what product and what wash cycle type are selected is the role of the control logic program that is driven by the dosing device's microchip (18). The control logic program allows to define the specific time to release the product.

Firstly, the dosing device (1) must memorize which product needs to be released. In one embodiment, the type of product is integrated into the dosing device (1) by programming it. This can be done by the user, for example by scanning the product container label. In this case, the label comprises a bar code that is read by the dosing device (1). In another embodiment, the dosing device (1) is constructed to be used with only one product, so the type of product to be used is memorized at the time the dosing device (1) is constructed.

Secondly, the dosing device (1) must memorize which type of wash cycle will be used, especially, what are the main phases of the wash cycle (main wash, rinses . . . etc.). It is known that typically, the consumers use 2 or 3 different wash program types, as a maximum. For each of them, the overall length of the cycle, the temperature, the number of rinses differ, but they can easily be learnt by the dosing device (1) after a few "training" washes. In this case, the dosing device (1) comprises a learning memory, as described above, which learns the 3 different types of wash types with their respective characteristics during the first washes.

Once the dosing device (1) has in memory the characteristics of the different types of wash cycles that can be used, and the type of product that needs to be released, it can release the product at the right time during a wash cycle, by using the sensors (16) who can sense and tell the dosing device (1) which type of wash cycle was selected, and what phase of the wash cycle is currently running. For example, enzymes can be sequentially released, and then inhibited by a specific inhibitor during the main wash, or a bleach can be released in the first rinse, or rinse additives such as fabric softener, easy ironing product, color care products can be released in the least rinse. This list of example is not exhaustive, and it can also apply to other types of treatments depending on the type of items to be treated (dishwashing, hot air fabric drying, etc.).

Process of Using the Dosing Device

It is another objective of the present invention to provide a process of dosing and/or dispensing at least one product into an appliance for treating laundry or dishes, by using a device according to claims 1 to 7, the process comprising the steps of:

(i) filling said device with said at least one product;

(ii) manually closing said device thereby loading the device with mechanical energy, switching it on;

(iii) placing said device within said appliance together with the laundry or dishes items to be treated, and start said appliance for a treatment cycle;

(iv) taking said device out of said appliance together with the laundry or dishes, once they have been treated.

The appliances in which the dosing device (1) is used includes but is not limited to vertical or horizontal laundry washing machines, automatic dishwashing machines, or hot air clothes dryers.

As previously explained, the dosing device (1) can be started on by twisting the cover (12) before pushing on it to close said device. Alternatively, the dosing device (1) comprises an electrical switch at the bottom of the plunger rod (21) which closes the electrical circuit when the user presses onto the cover (12) to close the device and starts said device on. Also alternatively, the on/off switch is independent from the plunger rod (21) and cover (12), and is a switch located at the surface of the device's housing (10).

What is claimed is:

1. A portable, self-contained, device for dosing and/or dispensing at least one product into an appliance for treating laundry or dishes, said device comprising a housing with at least one compartment for containing said at least one product, said at least one compartment being closed by at least one corresponding cover, and at least one actuator to open the cover of said at least one compartment, wherein said device comprises at least one means for storing energy and releasing it, so that said product is released at one or more predetermined point(s) in time during the wash cycle wherein said actuator comprises a mechanical actuator linked to the cover, said mechanical actuator being manually loaded with mechanical energy when a user presses the cover prior to placing said device into the washing machine, said mechanical energy being stored by locking the mechanical actuator in a loaded position through a locking means, said mechanical energy being released when said locking means is unlocked by an electromechanical actuator powered by the battery.

2. A device according to claim 1 wherein said mechanical actuator is a metallic coiled spring, said mechanical energy is spring compression energy, said electromechanical actuator is a solenoid, and said locking means is achieved by: (a) a locking tooth located onto the movable plunger rod, into which (b) a shaft of the solenoid moves in/out to respectively lock/unlock said spring.

* * * * *